US009837232B2

(12) United States Patent
Fellmer et al.

(10) Patent No.: US 9,837,232 B2
(45) Date of Patent: Dec. 5, 2017

(54) ELECTROMECHANICAL CIRCUIT BREAKER

(71) Applicant: Lisa Draexlmaier GmbH, Vilsbiburg (DE)

(72) Inventors: Marko Fellmer, Vilsheim (DE); Peter Faltermeier, Landshut (DE); Christian Gruber, Bodenkirchen (DE); Christoph Machner, Landshut (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 15/346,749

(22) Filed: Nov. 9, 2016

(65) Prior Publication Data

US 2017/0133184 A1 May 11, 2017

(30) Foreign Application Priority Data

Nov. 10, 2015 (DE) ..... 10 2015 119 352

(51) Int. Cl.
*H01H 51/20* (2006.01)
*H01H 50/54* (2006.01)
*H01H 50/56* (2006.01)

(52) U.S. Cl.
CPC ..... *H01H 50/541* (2013.01); *H01H 50/56* (2013.01); *H01H 51/20* (2013.01); *H01H 2235/01* (2013.01)

(58) Field of Classification Search
CPC ..... H01H 51/20
USPC ..... 335/119
See application file for complete search history.

(56) References Cited

U.S. PATENT DOCUMENTS 3,914,720 A * 10/1975 Drubig ..... H01H 71/34 335/14
8,476,997 B2 * 7/2013 Hrnjak ..... F02N 11/087 335/126

* cited by examiner

*Primary Examiner* — Ramon M Barrera
(74) *Attorney, Agent, or Firm* — Finnegan, Henderson, Farabow, Garrett & Dunner LLP

(57) ABSTRACT

An electromechanical circuit breaker comprising a main contact pair comprising a first main contact disposed on a first main contact bridge; an auxiliary contact pair comprising a first auxiliary contact disposed on a first auxiliary contact bridge, the first auxiliary contact bridge being connected in parallel to the first main contact bridge and wherein the auxiliary contact pair comprises a material that has a higher melting point than a material of the main contact pair; a first armature configured to move the first main contact bridge; a second armature configured to move the first auxiliary contact bridge, wherein the first and second armatures are configured such that the auxiliary contact pair opens after the main contact pair opens, and the auxiliary contact pair closes before the main contact pair closes.

20 Claims, 3 Drawing Sheets

ELECTROMECHANICAL CIRCUIT BREAKER

CROSS REFERENCE TO RELATED APPLICATIONS

This application is based upon and claims the benefit of prior German Patent Application No. 10 2015 119 352.3, filed on Nov. 10, 2015, the entire contents of which are incorporated herein by reference.

TECHNICAL FIELD

The present disclosure relates to an electromechanical circuit breaker for interrupting high currents.

BACKGROUND

The basic function of circuit breakers, also referred to as relays or contactors, consists of switching high electric power outputs in a load circuit with the aid of a comparatively small current, this being a control current. The current in the load circuit is several times greater than the control current.

One problem that arises with circuit breakers when high power outputs are switched is that arcs can develop during switching of the switch contacts and can result in wear of the switch contacts. These switch contacts are made of copper or silver, for example, in the circuit breakers known from the prior art. In particular at high voltages and currents, arcs inevitably develop between the switch contacts to be separated. These arcs are usually extinguished by the additional use of quenching gas or quenching magnets, for example, so as to achieve safe separation of the switch contacts and to prevent the arcs from jumping to neighboring components of the circuit breaker and damaging these. This, however, is often complex to implement, in particular when the circuit breaker is used in a motor vehicle.

The load currents that can flow with the use of circuit breakers in a vehicle can be as high as 1500 amperes or higher. When such a high load current flows as the contacts are being separated by the circuit breaker, the number of make-and-break cycles of circuit breakers used today is limited due to the design thereof. The separation of the switch contacts of such a circuit breaker, the contacts of which usually comprise copper or silver, takes place just a few times with an isolating current of this magnitude since the isolating current normally causes severe damage to the switch contacts of the circuit breaker. After a few make-and-break cycles, the circuit breaker must then already be replaced again, which increases the maintenance complexity of such circuit breakers.

SUMMARY

Embodiments of the present disclosure relate to an electromechanical circuit breaker that provides safe interruption of high currents while reducing the contact wear and increasing the make-and-break cycles.

The circuit breaker according to embodiments of the present disclosure comprises at least one main contact pair, wherein a main contact is disposed on a main contact bridge. Furthermore, the circuit breaker comprises at least one auxiliary contact pair comprising a material that has a higher melting point than the main contacts, wherein an auxiliary contact is disposed on an auxiliary contact bridge connected in parallel to the main contact bridge. The circuit breaker furthermore comprises a first armature for moving the main contact bridge and a second armature for moving the auxiliary contact bridge, wherein the armatures are designed in such a way that the auxiliary contact pair is opened after the main contact pair and closed before the main contact pair. During normal operation, both contact pairs are thus connected in parallel and can carry a high current, something to which in particular the superior main contact pair having better electrical conductivity contributes. Since the main contact pair opens before the auxiliary contact pair and closes later, the risk of damage to the main contact pair is low. This risk is borne by the auxiliary contact pair, which, however, is made of a tougher material.

The electromechanical circuit breaker according to embodiments of the present disclosure comprises a main contact pair comprising a first main contact disposed on a first main contact bridge; an auxiliary contact pair comprising a first auxiliary contact disposed on a first auxiliary contact bridge, the first auxiliary contact bridge being connected in parallel to the first main contact bridge and wherein the auxiliary contact pair comprises a material that has a higher melting point than a material of the main contact pair; a first armature configured to move the first main contact bridge; a second armature configured to move the first auxiliary contact bridge, wherein the first and second armatures are configured such that the auxiliary contact pair opens after the main contact pair opens, and the auxiliary contact pair closes before the main contact pair closes.

The electromechanical circuit breaker according to embodiments of the present disclosure comprises a main contact pair comprising a first main contact disposed on a first main contact bridge; and a second main contact disposed on a first contact pole; an auxiliary contact pair comprising a first auxiliary contact disposed on a first auxiliary contact bridge, the first auxiliary contact bridge being connected in parallel to the first main contact bridge; and a second auxiliary contact disposed on the first contact pole; a first armature configured to move the first main contact bridge; a second armature configured to move the first auxiliary contact bridge; a control unit configured to actuate the first and second armatures such that the auxiliary contact pair opens after the main contact pair opens; and the auxiliary contact pair closes before the main contact pair closes.

According to embodiments of the present disclosure, the circuit breaker creates two contact bridges that are separate from one another. The contact bridges are designed to reduce erosion and minimize the contact resistance between the individual contacts.

Embodiments of the present disclosure relate to safe interruption of high currents, in particular of currents greater than 1500 amperes.

According to embodiments of the present disclosure, the power losses are reduced due to the different material pairings of the contacts of the circuit breaker. Moreover, the circuit breaker according to the present disclosure enables a greater number of make-and-break cycles for the interruption of high currents. This results in longer service life of the circuit breaker and lowers the maintenance effort.

According to embodiments of the present disclosure, the contact resistance in the circuit breaker is reduced.

The foregoing general description and the following detailed description are exemplary and explanatory only, and are not restrictive of embodiments consistent with the present disclosure. Further, the accompanying drawings illustrate embodiments of the present disclosure, and together with the description, serve to explain principles of the present disclosure.

BRIEF DESCRIPTION OF THE DRAWINGS

The present disclosure will be described hereafter based on exemplary embodiments, which are described in greater detail based on drawings. In the drawings.

DETAILED DESCRIPTION

Figure 1:
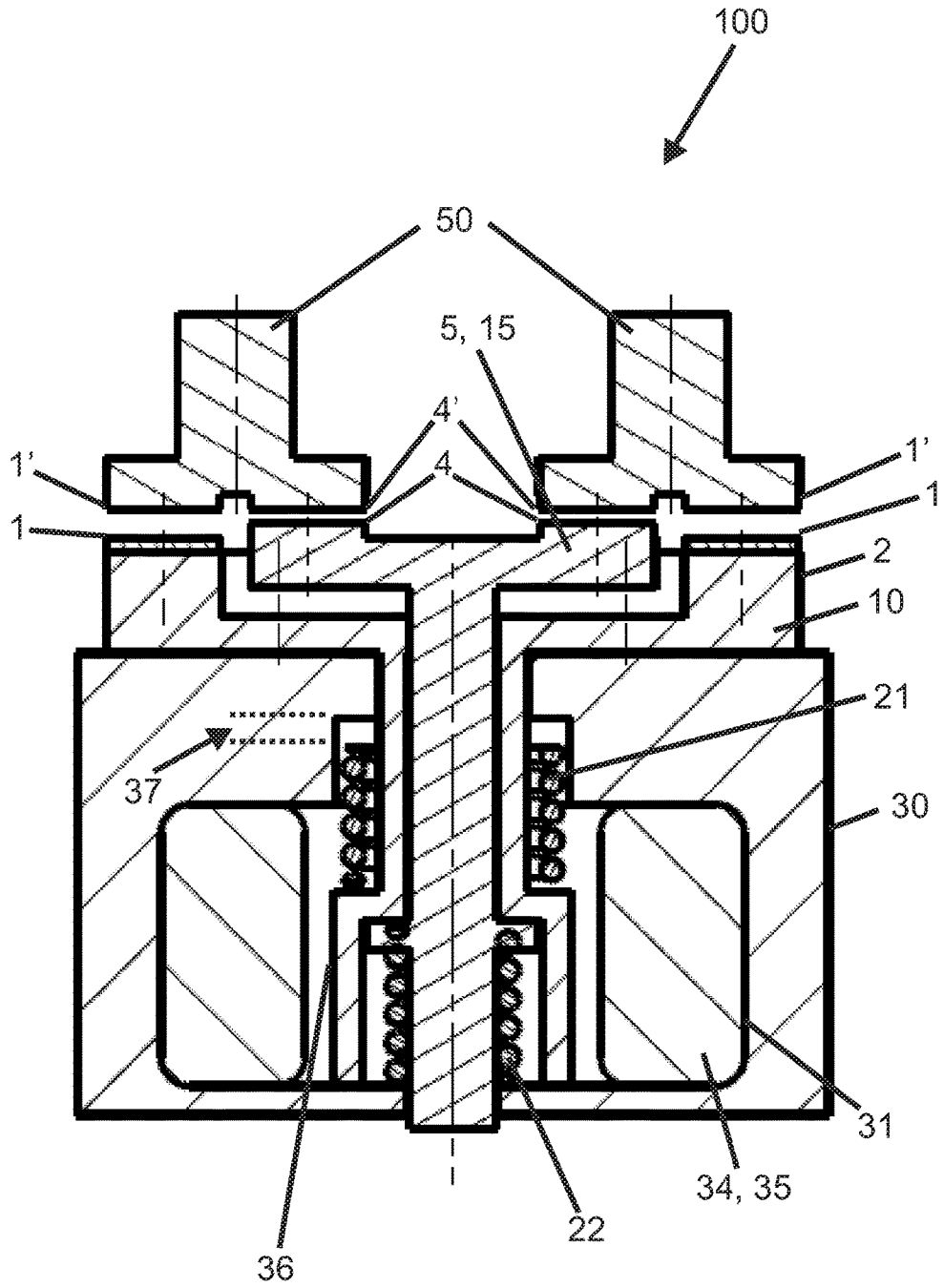
FIG. 1 shows a schematic illustration of the circuit breaker according to the present disclosure in a first position in which the main contacts and the auxiliary contacts are open.

In an embodiment of the present disclosure, a further main contact of the main contact pair and a further auxiliary contact of the auxiliary contact pair are disposed on a contact pole. The contact pole is the counterpart to the two contact bridges and includes at least one main contact and one auxiliary contact.

In an embodiment of the present disclosure, the circuit breaker comprises a control unit for actuating the two armatures, wherein the control unit is configured to activate the first armature and the second armature in such a way that the main contact pair is opened before the auxiliary contact pair and closed after the auxiliary contact pair. In this way, the arcs that develop when the contacts are opened are dissipated to the contact pair comprising a material having a higher melting point.

In an embodiment of the present disclosure, the control unit comprises a first spring element and a second spring element for preloading the first and second armatures, wherein the first spring element has a greater spring force than the second spring element. Activating the two armatures via spring elements provides space-saving activation and cost-effective implementation.

In an embodiment of the present disclosure, the first spring element is connected to the second spring element. The first spring element exerts a spring force on the second spring element which is directed against the spring force of the second spring element, so that the second armature for moving the auxiliary contact bridge is actuated so as to open the auxiliary contact pair after the main contact pair has been opened.

In an embodiment of the present disclosure, the control unit generates a force, by way of a drive unit, which counteracts the spring force of the first spring element allowing the auxiliary contact pair to be closed before the main contact pair. The second armature is disposed with respect to the first armature in such a way that a travel distance of the second armature is shorter than a travel distance of the first armature.

In an embodiment of the present disclosure, the drive unit comprises a coil so as to generate a magnetic force, which counteracts the spring force of the first spring element, when a current flows through the coil.

In an embodiment of the present disclosure, the material or the coating of the auxiliary contact pair having the higher melting point may be tungsten. The material or the coating of the main contacts having the higher electrical conductivity than the material of the auxiliary contacts may be silver. Using silver may reduce the contact resistance in the circuit breaker. Using tungsten, which has a high melting point, as the contact material for the auxiliary contact pair enables the auxiliary contact pair to tolerate high current loads and be more suitable for what is known as a sacrificial layer to switch these high loads.

The auxiliary contacts comprising tungsten have a lower electrical conductivity, and thus a higher contact resistance, than the main contacts provided with silver. However, the auxiliary contacts are more robust and durable with respect to arcs and thus suffer less damage than the main contacts. To ensure that the main contacts incur less damage from the arcs than the auxiliary contacts, the auxiliary contacts are closed before the main contacts and opened after the main contacts. This may increase the service life of the circuit breaker and the number of possible make-and-break cycles of the circuit breaker, even when arcs occur, since damage to the auxiliary contacts during opening and closing of the contacts is prevented by the tougher material and does not result in the immediate failure of the circuit breaker according to the present disclosure.

FIG. 1 shows a circuit breaker 100 comprising two main contact pairs 1, 1', wherein the two main contacts 1 are disposed on a main contact bridge 2. The main contact pairs 1, 1' are made of silver or a material comprising silver, or are coated with silver or are coated with a material comprising silver. The circuit breaker 100 furthermore comprises two auxiliary contact pairs 4, 4' comprising a material that has a higher melting point than the main contacts 1. The auxiliary contact pairs 4, 4' may be made of tungsten or coated therewith. Two auxiliary contacts 4 are disposed on an auxiliary contact bridge 5, which is connected in parallel to the main contact bridge 2. The circuit breaker 100 furthermore comprises a first armature 10 for moving the main contact bridge 2 and a second armature 15 for moving the auxiliary contact bridge 5. The armatures 10, 15 are designed in such a way that the auxiliary contact pair 4, 4' is opened after the main contact pair 1, 1' and closed before the main contact pair 1, 1'.

FIG. 1 furthermore shows that the circuit breaker 100 comprises a further main contact 1' of the main contact pair 1, 1' and a further auxiliary contact 4' of the auxiliary contact pair 4, 4' on a respective contact pole 50.

The circuit breaker 100 comprises a control unit 30 for actuating the armatures 10, 15. The control unit 30 is designed to activate the first armature 10 and the second armature 15 in such a way that the main contact pair 1, 1' is opened before the auxiliary contact pair 4, 4' and closed after the auxiliary contact pair 4, 4'.

In a first exemplary application, the control unit 30 activates the first armature 10 before the second armature 15 to open the main contact pair 1, 1' before the auxiliary contact pair 4, 4'. Thereafter, the control unit 30 activates the second armature 15 before the first armature 10 to close the auxiliary contact pair 4, 4' before the main contact pair 1, 1'. In a second exemplary application, the control unit 30 activates both armatures 10, 15 simultaneously. However, due to the shape of the two armatures 10, 15 and the arrangement thereof in relation to one another, a travel distance 36 of the second armature 15 for closing the auxiliary contact pairs 4, 4' is shorter than a travel distance 37 of the first armature 10 for closing the main contact pair 1, 1', such that the auxiliary contact pairs 4, 4' close before the main contact pairs 1, 1'. In a third exemplary application, the movement of the first armature 10 is faster than the movement of the second armature 15, so that the main contact pair 1, 1' opens before the auxiliary contact pair 4, 4' even with equally long path distances.

The control unit 30 furthermore comprises a first spring element 21 and a second spring element 22 for preloading the first and second armatures 10, 15. The first spring element 21 has a greater spring force than the second spring element 22. The first spring element 21 is configured for preloading the first armature 10. The second spring element 22 is configured for preloading the second armature 15. In the embodiment of the circuit breaker 100 according to FIG. 1, the first spring element 21 is connected to the second spring element 22. The first spring element 21 exerts a spring force on the second spring element 22 which is directed against the spring force of the second spring element 22, so that the second armature 15 for moving the auxiliary contact bridge 5 is actuated to open the auxiliary contact pairs 4, 4' after the main contact pairs 1, 1' have been opened.

Figure 2:
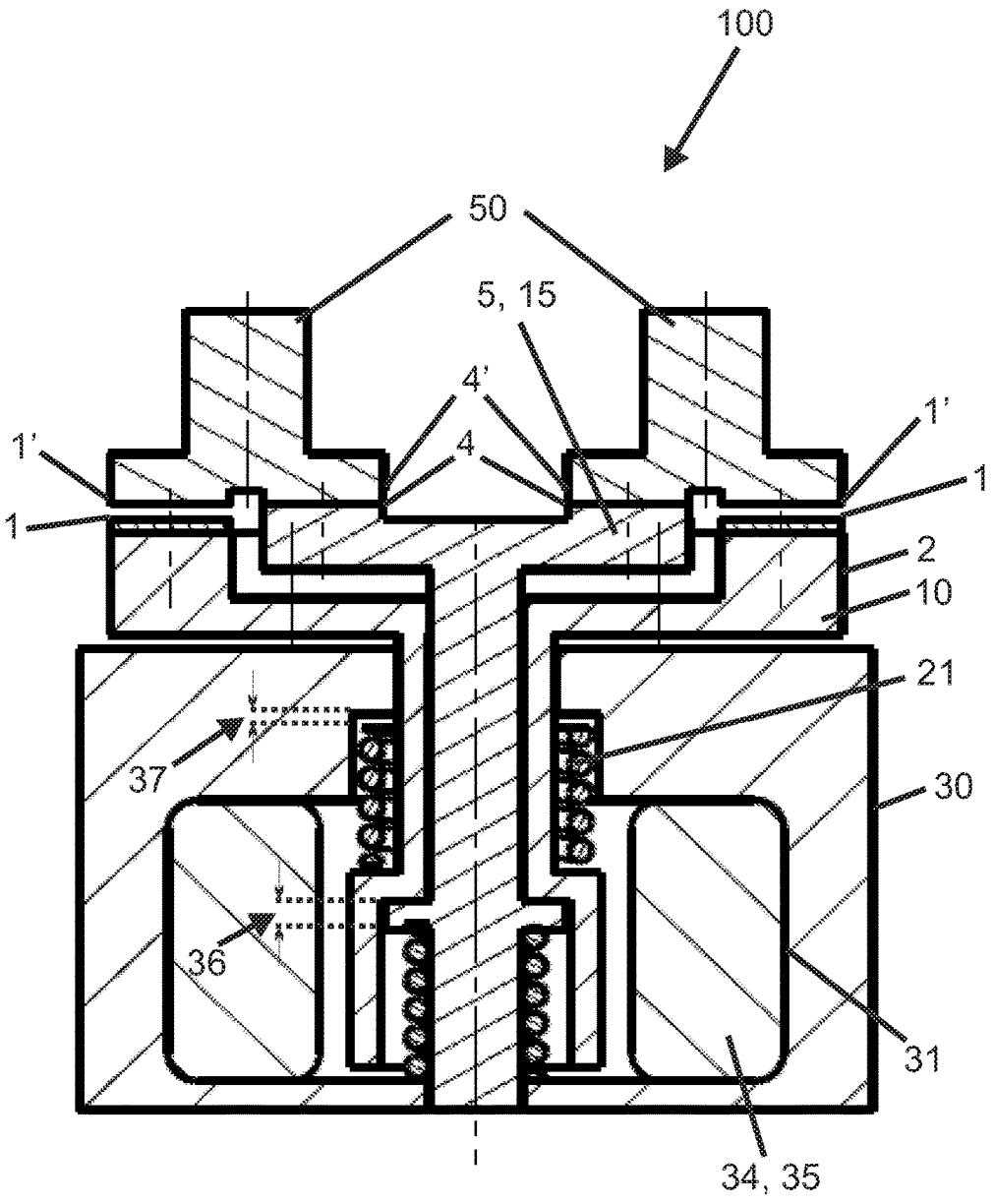
FIG. 2 shows a schematic illustration of the circuit breaker according to the present disclosure according to FIG. 1 in a second position in which the main contacts are open and the auxiliary contacts are closed.
Figure 3:
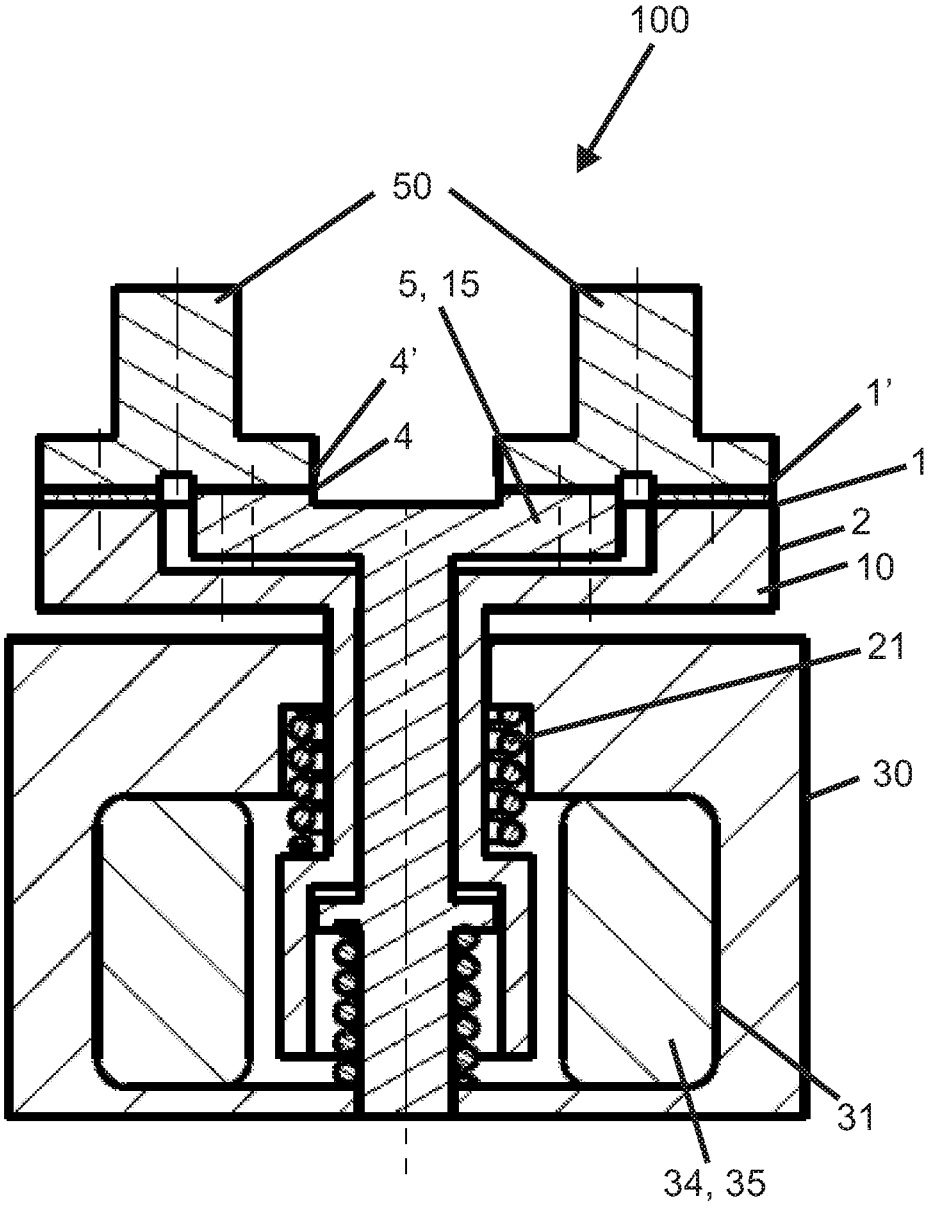
FIG. 3 shows a schematic illustration of the circuit breaker according to the present disclosure according to FIG. 1 in a third position in which the main contacts and the auxiliary contacts are closed.

The opening and the closing of the contacts of the circuit breaker 100 is described hereafter in greater detail based on FIGS. 1 to 3. In FIG. 1, the circuit breaker 100 is in the starting position thereof, in which all the contacts of the circuit breaker 100, i.e. the two main contact pairs 1, 1' and the two auxiliary contact pairs 4, 4', are open. The two armatures 10, 15 are pushed downward by the first spring element 21. The first spring element 21 has a greater spring force than the second spring element 22 for this purpose. The first spring element 21 surrounding the first armature 10 thus also acts on the second armature 15.

So as to transfer the two main contact pairs 1, 1' and the two auxiliary contact pairs 4, 4' from the starting position according to FIG. 1 into a closed position according to FIG. 2 or FIG. 3, a magnetic force which counteracts the first spring element 21 is required. The magnetic force is generated by a coil 35 in a drive unit 34 through which a current flows. The drive unit 34 and the coil 35 are integral parts of the control unit 30. The movement of the two armatures 10, 15 takes place by way of a magnetic force generated by a magnetic field that is formed by the coil 35 through which a current flows. However, alternatively the drive unit 35 for moving the two armatures 10, 15 could also be provided by an electric drive when the spring forces alone are not sufficient to move the two armatures.

Since the second armature 15 has to cover a shorter path or a shorter travel distance 36 to move the auxiliary contact bridge 5 than the first armature 10 to move the main contact bridge 2, which covers a travel distance 37, initially the contacts of the auxiliary contact pairs 4, 4' are closed, as is illustrated in FIG. 2. Thereafter, the movement of the first armature 10, on which the magnetic force continues to act, also closes the contacts of the main contact pairs 1, 1', as is illustrated in FIG. 3.

A current through the circuit breaker 100 will thus take the path of least resistance and flow across the main contact pair 1, 1' of the first contact pole 50, which may be coated with silver or a silver alloy or is made of a silver-containing material, to the main contact pair 1, 1' of the second contact pole 50. Silver has a melting point of approximately 962 degrees Celsius. Tungsten has a melting point of approximately 3422 degrees Celsius. Silver also has a better electrical conductivity than tungsten.

The transfer of the switch contacts of the circuit breaker 100 from a closed position, as is illustrated in FIG. 3, into an open position according to FIG. 1, takes place as follows in the circuit breaker according to the present disclosure. First, the current is interrupted by the coil 35, so that the created magnetic field disappears and consequently a magnetic force can no longer act on the first spring element 21. Since the spring element 21 has a greater spring force than the spring element 22 and the two armatures 10, 15 are connected to one another, a spring force from the first spring element 21 acts on the spring element 22 in this position. The first spring element 21 thus extends or expands, so that the first armature 10 comprising the contact surfaces made of silver is moved in such a way that the main contacts of the main contact pairs 1, 1' are separated from one another first. The expansion of the first spring element 21 causes a force to be exerted by the first armature 10 on the second armature 15. This causes the second armature 15 to move downward and the second spring element 22 to be compressed. As a result, after the main contacts have been opened, the auxiliary contacts of the auxiliary contact pairs 4, 4' comprising the material made of tungsten are now also separated from one another. After this process, the two armatures 10, 15 are separated from the two contact poles 50, as is shown in FIG. 1.

The shown embodiments of the circuit breaker 100 according to FIGS. 1-3 describe what is known as a twin-contact circuit breaker. However, the principle according to the present disclosure of the circuit breaker 100 also works when the circuit breaker 100 has only one contact pole 50 (not shown), which can be contacted with a main contact pair 1, 1' and an auxiliary contact pair 4, 4'. By using a main contact pair 1, 1' and an auxiliary contact pair 4, 4', two contact bridges that are separate from one another are formed, which reduces the erosion of the contacts at high load currents during the separation of the contacts and minimizes the contact resistance of the circuit breaker, which also results in a reduction of the power losses.

While the present disclosure is illustrated and described in detail according to the above embodiments, the present disclosure is not limited to these embodiments and additional embodiments may be implemented. Further, other embodiments and various modifications will be apparent to those skilled in the art from consideration of the specification and practice of one or more embodiments disclosed herein, without departing from the scope of the present disclosure.

The invention claimed is:

1. An electromechanical circuit breaker comprising:

a main contact pair comprising a first main contact disposed on a first main contact bridge;

an auxiliary contact pair comprising a first auxiliary contact disposed on a first auxiliary contact bridge, the first auxiliary contact bridge being connected in parallel to the first main contact bridge, the auxiliary contact pair comprising a material that has a higher melting point than a material of the main contact pair;

a first armature configured to move the first main contact bridge; and a second armature configured to move the first auxiliary contact bridge;

wherein the first and second armatures are configured such that the auxiliary contact pair opens after the main contact pair opens, and the auxiliary contact pair closes before the main contact pair closes.

2. The circuit breaker according to claim 1, wherein:

the main contact pair comprises a second main contact disposed on a contact pole; and the auxiliary contact pair comprises a second auxiliary contact disposed on the contact pole.

3. The circuit breaker according to claim 1, further comprising:

a control unit configured to actuate the first and second armatures such that the main contact pair opens before the auxiliary contact pair opens, and the main contact pair closes after the auxiliary contact pair closes.

4. The circuit breaker according to claim 3, wherein the control unit further comprises:

a first spring element for preloading the first armature; and a second spring element for preloading the second armature, wherein the first spring element has a greater spring force than the second spring element.

5. The circuit breaker according to claim 4, wherein the first spring element is connected to the second spring element and exerts a force which is directed against a spring force of the second spring element such that the second armature is actuated to open the auxiliary contact pair after the main contact pair has been opened.

6. The circuit breaker according to claim 4, wherein:

the control unit further comprises a drive unit configured to generate a force to counteract the spring force of the first spring element; and the second armature is disposed with respect to the first armature such that a travel distance of the second armature for closing the auxiliary contact pair is shorter than a travel distance of the first armature for closing the main contact pair.

7. The circuit breaker according to claim 6, wherein the drive unit comprises a coil configured to generate a magnetic force that counteracts the spring force of the first spring element when a current flows through the coil.

8. The circuit breaker according to claim 1, wherein the main contact pair comprises a material having a higher electrical conductivity than a material of the auxiliary contact pair.

9. The circuit breaker according to claim 1, wherein the auxiliary contact pair comprises tungsten, and the main contact pair comprises silver.

10. An apparatus, comprising:

a main contact pair comprising:

a first main contact disposed on a first main contact bridge; and a second main contact disposed on a first contact pole;

an auxiliary contact pair comprising:

a first auxiliary contact disposed on a first auxiliary contact bridge, the first auxiliary contact bridge being connected in parallel to the first main contact bridge, wherein the auxiliary contact pair comprises a material that has a higher melting point than a material of the main contacts; and a second auxiliary contact disposed on the first contact pole;

a first armature configured to move the first main contact bridge; and a second armature configured to move the first auxiliary contact bridge;

wherein the first and second armatures are configured such that the auxiliary contact pair opens after the main contact pair opens, and the auxiliary contact pair closes before the main contact pair closes.

11. The apparatus according to claim 10, further comprising:

a control unit configured to actuate the first and second armatures such that the main contact pair opens before the auxiliary contact pair opens, and the main contact pair closes after the auxiliary contact pair closes.

12. The apparatus according to claim 11, wherein the control unit further comprises:

a first spring element for preloading the first armature; and a second spring element for preloading the second armature, wherein the first spring element has a greater spring force than the second spring element.

13. The apparatus according to claim 12, wherein the first spring element is connected to the second spring element and exerts a force which is directed against a spring force of the second spring element such that the second armature is actuated to open the auxiliary contact pair after the main contact pair has been opened.

14. The apparatus according to claim 12, wherein:

the control unit further comprises a drive unit configured to generate a force to counteract the spring force of the first spring element; and the second armature is disposed with respect to the first armature such that a travel distance of the second armature for closing the auxiliary contact pair is shorter than a travel distance of the first armature for closing the main contact pair.

15. The apparatus according to claim 14, wherein the drive unit comprises a coil configured to generate a magnetic force that counteracts the spring force of the first spring element when a current flows through the coil.

16. The apparatus according to claim 10, wherein the main contact pair comprises a material having a higher electrical conductivity than the material of the auxiliary contact pair.

17. The apparatus according to claim 10, wherein the auxiliary contact pair comprises tungsten or a tungsten coating, and the main contact pair comprises silver or a silver coating.

18. The apparatus according to claim 10, further comprising:

a second main contact pair comprising:

a third main contact disposed on a second main contact bridge; and a fourth main contact disposed on a second contact pole;

wherein a current passing through the apparatus flows across the first main contact pair to the second main contact pair when the first and second contact pairs are closed.

19. An electromechanical circuit breaker, comprising:

a main contact pair comprising:

a first main contact disposed on a first main contact bridge; and a second main contact disposed on a first contact pole;

an auxiliary contact pair comprising:

a first auxiliary contact disposed on a first auxiliary contact bridge, the first auxiliary contact bridge being connected in parallel to the first main contact bridge; and a second auxiliary contact disposed on the first contact pole;

a first armature configured to move the first main contact bridge;

a second armature configured to move the first auxiliary contact bridge; and a control unit configured to actuate the first and second armatures such that:

the auxiliary contact pair opens after the main contact pair opens; and the auxiliary contact pair closes before the main contact pair closes.

20. The electromechanical circuit breaker according to claim 19, wherein the control unit further comprises:

a first spring element for preloading the first armature; and a second spring element for preloading the second armature, wherein the first spring element has a greater spring force than the second spring element.

* * * * *